US010012013B2

(12) United States Patent
Scholz et al.

(10) Patent No.: US 10,012,013 B2
(45) Date of Patent: Jul. 3, 2018

(54) LOCK FOR A FLAP OR DOOR

(71) Applicant: Kiekert Aktiengesellschaft, Heiligenhaus (DE)

(72) Inventors: Michael Scholz, Essen (DE); Armin Handke, Duisburg (DE); Michael Herrmann, Neukirchen-Vluyn (DE); Karsten Barth, Hattingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 477 days.

(21) Appl. No.: 14/398,839

(22) PCT Filed: May 2, 2013

(86) PCT No.: PCT/DE2013/000243

§ 371 (c)(1),
(2) Date: Nov. 4, 2014

(87) PCT Pub. No.: WO2013/163980

PCT Pub. Date: Nov. 7, 2013

(65) Prior Publication Data

US 2015/0115627 A1 Apr. 30, 2015

(30) Foreign Application Priority Data

May 4, 2012 (DE) ..... 10 2012 207 440

(51) Int. Cl.
*E05C 3/16* (2006.01)
*E05B 85/20* (2014.01)
(Continued)

(52) U.S. Cl.
CPC ..... *E05B 85/20* (2013.01); *E05B 17/0062* (2013.01); *E05B 77/04* (2013.01); *E05B 85/26* (2013.01); *Y10T 292/1075* (2015.04)

(58) Field of Classification Search
CPC ..... E05B 85/20; E05B 85/26; E05B 17/0062; E05B 77/04
(Continued)

(56) References Cited

U.S. PATENT DOCUMENTS 4,756,563 A * 7/1988 Garwood ..... E05B 85/243 292/216
5,046,769 A * 9/1991 Rimbey ..... E05B 77/265 292/216
(Continued)

FOREIGN PATENT DOCUMENTS

DE FR 2243314 A1 * 4/1975 ..... E05B 85/045
DE 10 2005 035898 A1 2/2007
(Continued)

OTHER PUBLICATIONS

International Search Report for corresponding patent application No. PCT/DE2013/000243 dated Jan. 27, 2014.

*Primary Examiner* — Alyson M Merlino
(74) *Attorney, Agent, or Firm* — Renner, Otto, Boisselle & Sklar, LLP

(57) ABSTRACT

The invention relates to a door lock or flap lock comprising a locking mechanism that consists of a latch (1) and at least one pawl (2) for locking the latch (1). The locking surface of the pawl is so narrow that even slight pivoting movements are sufficient to unlock a locked locking mechanism, thus allowing for a reduction in volume and weight.

7 Claims, 4 Drawing Sheets

(51) Int. Cl.
*E05B 85/26* (2014.01)
*E05B 77/04* (2014.01)
*E05B 17/00* (2006.01)

(58) Field of Classification Search
USPC ..... 292/194, 195, 201, 216, DIG. 22, 292/DIG. 23, DIG. 65
See application file for complete search history.

(56) References Cited

U.S. PATENT DOCUMENTS

| | | | | | |
|---|---|---|---|---|---|
| 5,054,827 | A * | 10/1991 | Konchan | E05B 85/243 | 292/216 |
| 6,575,003 | B1 * | 6/2003 | Dupont | E05B 81/14 | 292/201 |
| 9,845,619 | B2 * | 12/2017 | Bendel | E05B 77/04 | |
| 2003/0020285 | A1 * | 1/2003 | Kluting | E05B 77/02 | 292/216 |
| 2008/0136196 | A1 | 6/2008 | Pecoul et al. | | |
| 2010/0052336 | A1 | 3/2010 | Bendel et al. | | |
| 2010/0127512 | A1 | 5/2010 | Vazquez et al. | | |
| 2011/0074166 | A1 * | 3/2011 | Taurasi | E05B 81/14 | 292/27 |
| 2011/0127780 | A1 | 6/2011 | Barth et al. | | |
| 2011/0169280 | A1 * | 7/2011 | Scholz | E05B 85/26 | 292/200 |
| 2011/0169282 | A1 * | 7/2011 | Scholz | E05B 85/26 | 292/220 |
| 2011/0210565 | A1 * | 9/2011 | Scholz | E05B 85/26 | 292/200 |
| 2014/0291998 | A1 * | 10/2014 | Pettengill | E05B 85/00 | 292/96 |
| 2015/0167363 | A1 * | 6/2015 | Scholz | E05B 85/20 | 292/200 |

FOREIGN PATENT DOCUMENTS

| | | | | |
|---|---|---|---|---|
| DE | 10 2007 003948 | A1 | 5/2008 | |
| DE | 10 2008 035607 | A1 | 2/2010 | |
| DE | 10 2008 061524 | A1 | 6/2010 | |
| DE | 10 2010 003483 | A1 | 3/2011 | |
| DE | 10 2010 036924 | A1 | 12/2011 | |
| DE | 102010023901 | A1 * | 12/2011 | E05B 85/26 |
| DE | 102010023904 | A1 * | 12/2011 | E05B 85/26 |
| DE | 102011002897 | A1 * | 7/2012 | E05B 77/40 |
| DE | 102011003295 | A1 * | 8/2012 | E05B 77/34 |
| DE | 102011084960 | A1 * | 4/2013 | E05B 85/26 |
| FR | 2 882 773 | A1 | 9/2006 | |
| WO | 2010/142261 | A1 | 12/2010 | |

* cited by examiner

LOCK FOR A FLAP OR DOOR

This application is a national phase of International Application No. PCT/DE2013/000243 filed May 2, 2013 and published in the English language, which claims priority to German Patent Application No. DE 10 2012 207 440.6 filed May 4, 2012, which are all hereby incorporated herein by reference in their entirety.

FIELD OF THE INVENTION

The invention relates to a lock for a flap or a door. An exemplary lock is disclosed in publication DE 10 2008 061 524 A1. The door or flap can be a door or flap of a motor vehicle or of a building.

BACKGROUND OF THE INVENTION

The aforementioned lock comprises a locking mechanism that contains a rotary latch and at least one pawl with which the rotary latch can be locked in a closed position by locking surfaces of the pawl and rotary latch. Locking surfaces refers to surfaces on the pawl and rotary latch abutting to ensure locking of the locking mechanism and that result in overlapping. In a closed position the rotary latch can keep a door or flap closed, so that the door or flap cannot be opened. If the rotary latch is in an open position, the locking bolt can leave the locking mechanism and the door and flap can be opened.

A rotary latch contains a load arm and a collecting arm. In case of a locked locking mechanism the load arm prevents a locking bolt of a door or flap from disengaging from the locking mechanism. If a door or flap is closed, the closing bolt is moved against the load arm moving it and thus also the rotary latch in the direction of the closed position.

Publication DE 10 2010 003 483 A1 discloses a locking mechanism, in which the rotary latch initiates an opening moment in the pawl when the pawl latches the rotary latch in the fully closed position. The rotary latch can for instance initiate such a moment in the pawl as a result of a door sealing pressure and/or due to a pretensioned spring that can turn the rotary latch into its opening position and/or can initiate such a torque in the pawl by opening of a respective door or flap. The pawl can be moved out of its locked position into its detent position by an opening moment. In order to reliably prevent this in the event of a locked locking mechanism, the arrangement also contains a blocking lever that can block the movement of the pawl out of its detent position. To open such a locking mechanism, the blocking lever is moved out of its blocking position with the aid of the release lever. Generally the opening moment initiated by the rotary latch in the pawl suffices to unlock the locking mechanism, i.e. to open it.

In a locking mechanism with the aforementioned opening moment it can happen for a variety of reasons that the opening moment does not suffice to move the pawl out of its locking position. In order to ensure that the locking mechanism opens also in the event of such a malfunction, a tappet is provided that is, for instance, attached to the release lever and/or the intermediate closed position pawl disclosed in DE 10 2010 003 483 A1. Such a tappet should move the pawl out of its locking position in particular if the pawl is unable to leave the locking position solely as a result of the opening moment.

In order for the tappet to be able to open the locking mechanism, it must be possible to pivot the tappet arranged, for instance, on the release lever by a sufficiently large angle.

In general, an angle of between 20° to 30° suffices, such as approx. 25°, for the pawl to be moved out of its locking position solely by means of the tappet.

A release lever of a locking mechanism is generally moved by actuation of a handle in order to release a locking mechanism. The handle can be an internal door handle or an external door handle of a motor vehicle. Such a handle is generally connected to the release lever via a rod assembly or a Bowden cable in order to move the release lever upon actuation of the handle. Where the rod assembly or the Bowden cable wear out due to ageing, this can also reduce the pivot range by which the release lever can be pivoted by actuation of a handle. It may then not be possible to reliably open the locking mechanism.

In particular in case of a motor vehicle only limited space is available. Experts also, in particular in case of motor vehicles, endeavor to reduce weight. In case of locks it is in particular in motor vehicles important that the locks are small and easily produced.

SUMMARY OF THE INVENTION

Unless specified differently below, the above characteristics can on their own or in combination be part of the invention.

The aim of the invention is to provide a reliably working lock of the type described above.

The aim of the invention is achieved by a lock with the characteristics of the first claim. Advantageous embodiments are disclosed in the sub claims.

In order to solve this task, a lock for a door or flap comprising a locking mechanism consisting of a rotary latch and at least one pawl is provided for locking the rotary latch. In order to reduce required space and weight, the locking surface of the locking arm of the pawl with which the rotary latch can be locked is that narrow or that short when viewed in the pivoting direction that a pivot movement of the pawl of up to 16.1°, and preferably of up to 14.6° and particularly preferably of 12.9° suffices to release the locking mechanism. Although experts were of the opinion that a locking surface of the locking arm of a pawl had to be significantly wider and in particular in the area of the locking surface on which the rotary latch rests in the locked condition in order to provide a significantly greater pivoting angle of the pawl and significantly greater than 14°, such as for instance of 20°, in order to prevent opening of the locking mechanism, for instance, in case of a crash or under excessive loads. The invention is, however, based on the knowledge that such a width of a locking surface of a locking arm is not mandatory in order to ensure that a locking mechanism can also not open under excessive loads. It was thus established that the width of a locking surface of a locking arm could be noticeably narrower compared to usual locking surface width of a pawl, in order to reduce volume and weight.

In a usual locking mechanism, one end of the load arm of the rotary latch rests at around the centre of a locking surface of the locking arm of the pawl serving for locking, when in the locked condition. In the invention, the position of the locking surface is changed in comparison and in such a way that the distance between the support point of the rotary latch and one end of the locking surface is significantly smaller than the distance to the other end of the locking surface. The one end of the locking surface of the pawl is the end moved in the direction of the support point of the rotary latch in the locked state in order to unlock the locking mechanism. As part of a relative movement, the respective end of the load arm of the rotary latch is finally moved past this end, so that the rotary latch can then be pivoted in the direction of its open position. Locking surface refers to the entire surface suitable for preventing the rotary latch from moving noticeably in the direction of the opening position.

This embodiment achieves that, on one hand, it is ensured that the rotary latch is still locked in the desired manner, when the locking arm of the pawl has for some reason, i.e. unplanned reason, moved a considerable way in the direction of its closing position, relative to the load arm of the rotary latch, for instance due to a described overlapping size when exposed to an excessive load. On the other side, a relatively small pivoting movement of the pawl in the direction of its open position suffices in order to release the locking mechanism.

Viewed from the centre of the support point, the length of the smaller distance in a preferred embodiment is up to 40% of the width of the locking surface of the pawl, with up to 30% being particularly preferred in order to achieve the described effect.

Tests have shown that in a usual locking mechanism neither the rotary latch nor the pawl are distorted or deformed by an excessive load. Instead, the support points of the axes of the rotary latch and of the pawl as well as the lock plate or the lock housing on which the locking mechanism is mounted are deformed. In one embodiment of the invention such support points are therefore sufficiently sturdier compared to the usual locking mechanism and are provided, in particular, with larger axle diameters. In this way it can be ensured that the locking mechanism cannot open even when exposed to excessive loads of, for instance, 20 to 30 kN. Such reinforcement measures, e.g. enlarging of the diameter of axes, leads to a slight increase in weight. By decreasing the width of the pawl locking arm, made possible by this new design, the total weight is, however, generally reduced. Enlarging of the diameter of an axis generally does not result in a larger overall volume, as such enlargement only results in larger recesses or holes in the lock plate and components such as the rotary latch and pawl. A reduction of the width of the locking arm of the pawl does, however, allow a reduction of the overall volume. All in all it is therefore advantageous to increase support points in order to permit a narrower width of a locking arm of the pawl.

In a preferred embodiment the locking mechanism is designed in such a way that in case of excessive stresses, the rotary latch is deformed in such a way that the rotary latch remains in its locked position and, in particular, due to a predetermined bending point of the rotary latch. The predetermined bending point is preferably provided on the load arm. The overlap between the rotary latch and the pawl remains despite of excessive stresses. Preferably it is even increased. The predetermined bending point of the load arm can also be provided in such a way that in case of excessive stressing the distance between the ends of the load arm and collecting arm is increased. The predetermined bending point is, however, generally arranged on the load arm as in the closed state of a door or flap, the load arm is not directly impinged on by the locking bolt of a door or flap. The provision of a predetermined bending point on the load arm is therefore particularly unproblematic.

This arrangement prevents the locking surface of the rotary latch from being released from the locking surface of the pawl due to deformations caused by excessive loads of, for instance 10 kN to 30 kN resulting in an unplanned opening of the locking mechanism. In one embodiment the collecting arm is, in particular, buckled in relation to the load arm as a result of excessive loading so that an overlap or an increased overlap between rotary latch and pawl is produced. The bending generally increases the distance between the two free ends of the collecting arm and load arm. In this embodiment it is not necessary to reinforce the support points compared to the support points of usual locking mechanisms in order to prevent a locking mechanism from opening also in the event of a crash.

This embodiment also provides a tolerance compensation. A planned overlap of the locking surfaces of the pawl and rotary latch can have been reduced due to greater tolerances at the support points of rotary latch and pawl and/or due to deformations of supported plastic parts. There is still no threat of an unplanned opening of the locking mechanism in case of excessive stresses as the overlap between the rotary latch and pawl would generally increase.

The predetermined bending point is preferably arranged in a recess and/or contains at least a recess, as a predetermined bending point can thus be provided with little production effort. The recess is preferably arranged on the side of the collecting arm facing away from the locking bolt of a door or flap in a locked position of the locking mechanism.

A recess can be provided by an opening in the rotary latch. In other words, the recess forms a clearance in the rotary latch. A recess can extend from a lateral contour of the rotary latch, i.e. from a lateral contour of a collecting arm towards the inside of the rotary latch, in particular towards the axis of rotation of the rotary latch, in order to provide a predetermined bending point. According to the invention at least one recess can be provided in the collecting or load arm. The collecting or load arm can, however, also contain two and more recesses. A recess can be provided by one or several holes through the rotary latch.

Preferably two recesses that are spaced apart are formed or provided in an arm of the rotary latch, in particular the collecting arm, facing the lock holder in the closed state of the locking mechanism. A second recess spaced apart from a first recess can advantageously reduce the weight of the rotary latch and/or can positively influence the bending behavior. There is also the option of, for instance, locating the recess, in the rotary latch in such a way that material remolded between the two recesses can, for instance, also serve as a stop for the intermediate closed position of the locking mechanisms.

In a further preferred embodiment, an elevation or an arm is provided in the area of the rotary latch, situated between the recesses that can be used for locking the locking mechanism in the intermediate closed position. A first recess facing the rotary latch can be used to define the position of a predetermined bending point, preferably on the collecting arm. This allows for instance changing of the predetermined bending point depending on the depth of the first recess in the rotary latch, i.e. a radial extension of the recess in direction of a pivot point of the rotary latch. The position of the predetermined bending point can also influence the overlap between rotary latch and pawl. Where, for instance, a recess extending deep into the rotary latch from its outer edge is inserted in the rotary latch, the depth of the recess determines the position of the predetermined bending point.

In the event of the locking mechanism being excessively stressed, such as in the event of an accident, the locking mechanism may not be released. The rotary latch and pawl must remain engaged. This can be positively assisted by the provision of a predetermined bending point in the rotary latch as disclosed in the invention. Where part of the rotary latch buckles appropriately over the predetermined bending point, the point of engagement between the rotary latch and pawl moves in the direction of a greater overlap, i.e. a release is not only prevented but the locking mechanism is also additionally secured. This clearly shows that as a result of the position of the predetermined bending point, a relative movement in the area of the point of engagement between the rotary latch and the pawl is controllable in the even of excessive stresses. In other words, the invention allows influencing of the overlap between rotary latch and pawl in the event of high or excessive stressing.

A deep recess extending from a lateral contour in the rotary latch produces a long lever arm and thus in particular a preferred enlargement of an overlap when exposed to stressing. Lever arm refers to the distance between the position of the bending point (predetermined bending point) and the point of engagement between the rotary latch and pawl.

Even a small recess, i.e. a recess extending from the outside into an inner area of the rotary latch can also produce a considerable increase in overlap. A shorter lever arm does, however, result in less movement of the point of engagement between the rotary latch and pawl towards creating a greater overlap.

Alternative or in addition, the predetermined bending point can be realized through changed material properties (elasticity), thickness, reduced bending stiffness, reduction of cross section and/or a reduction of stability. The material can, for instance have become weaker at a predetermined point as a result of retrospective processing, in order to provide a predetermined bending point in this way. The material thickness can be reduced at one point, in order to achieve a predetermined bending point at a desired point. It is, for instance, possible that material properties are changed at a point or in an area in order to provide a predetermined bending point. This can, for instance, be achieved by heat treatment with areas of greater or less hardness being produced in the rotary latch. When excessive stresses are applied to the lock and thus the locking mechanism as, for instance, in case of an accident the area with the reduced hardness acts as a predetermined bending point, prevents a release of the locking mechanism. In comparison, a predetermined bending point provided by at least one recess is preferable as generally no additional production effort is required for this purpose.

By choosing a favorable position of the predetermined bending point, the overlap is preferably increased, ensuring a particular reliable locking of the locking mechanisms.

Alternatively or in combination with changed material properties, the rotary latch and preferably the collecting arm can contain a reduced cross section. A reduced cross section can be provided on one or both sides of the rotary latch. A reduction on both sides offers the advantage of a symmetric design of the rotary latch and can also positively influence a potential deformation of the rotary latch. It is also possible that the rotary latch contains two or more reductions in cross section in order to define a predetermined bending point and to specifically influence a bending behavior of the predetermined bending point. One or several recesses of different length can also be provided along the rotary latch. Several recesses can, for instance, be provided, forming continuously increasing lengths or increasing and then decreasing lengths in the rotary latch. Such an embodiment does, however, require more manufacturing work compared, in particular, to a recess extending from a lateral contour towards the inside of the rotary latch and, in particular, in the direction of the axis of rotation of the rotary latch.

In one embodiment of the invention, recesses can be molded, stamped and/or applied to the rotary latch by machining. At least partial reductions in thickness of the rotary latch are also regarded as recesses. A recess or recesses can, for instance, also be milled or stamped into the rotary latch.

In another embodiment, the recesses can contain a cross section that can be described as a continuous radius and/or U-shape and/or a pointed notch. Using the shape of the cross section, the number of notches and thus the predetermined bending point can be advantageously influenced.

Preferably, a rotary latch is provided with a predetermined bending point able to initiate an opening moment in the pawl as the problem described above occurs, in particular, in such locking mechanisms. The lock can contain one or two pawls. Apart from an intermediate closed position the lock can also contain a fully closed position in which the locking mechanism can be locked. The rotary latch can thus contain one or two locking surfaces for locking. The lock can contain a blocking lever, blocking the pawl in the detent position. The rotary latch can initiate an opening, a closing or no torque in the pawl in the detent position.

The locking mechanism is preferably designed in such a way that a release lever of the locking mechanism only has to be pivoted by 8°-18.5° and preferably by only 10.5°-15.5°, in order to reliably open the locking mechanism—when it is locked—and in particular with the aid of a tappet for the pawl that is able to move the pawl out of its detent position by pivoting the release lever. Where, for instance for reasons of age, the release lever can no longer be pivoted by more than 20° when operating a handle, this embodiment ensures that the locking mechanism can still be reliably opened.

In particular, the tappet only moves the pawl out of its detent position when the pawl is not moved out of its detent position by an initiated opening moment. The tappet thus ensures that the pawl is moved out of its detent position when the opening mechanism fails due to the initiated opening torque.

In order to ensure that in a respective embodiment the release lever does not only move a blocking lever away from the pawl but also the pawl out of the engagement area of the rotary latch, the release lever must be regularly pivoted by more than 10°. Only once the release lever has been pivoted by more than 10° does a tappet, generally attached to the release lever interact with the pawl, causing the pawl to be mechanically pivoted by the release lever. For this reason it is preferable that the release lever can be pivoted by more than 10° in order to ensure that the tappet can engage and move the pawl when required.

The tappet thus ensures that the pawl is moved out of its detent position if an opening mechanism fails to do so after an initiated opening torque.

In one embodiment the locking mechanism contains an intermediate closed position pawl, preferably also acting as the release lever. In this embodiment, in particular, the rotary latch preferably contains an arm for locking in the intermediate closed position, separated by a recess from the generally deformable arm with the locking surface. In the intermediate closed position, an arm of the pawl, preferably of an intermediate closed position pawl rests against this arm of the rotary latch, in order to lock the rotary latch in the intermediate closed position. This embodiment allows the provision of a predetermined bending point on the collecting arm as well as the provision of a locking surface for the intermediate closed position pawl at the desired point. This arm for the intermediate closed position pawl extends, in particular, past the level provided by the surface area of the rotary latch. This allows the provision of a release lever for the intermediate closed position above the pawl, also forming an intermediate closed position pawl.

In one embodiment, the locking mechanism contains a blocking lever that can block the pawl in its detent position. The pawl is unable to leave its detent position if it is blocked by the blocking lever. The locking mechanism can be particularly reliably locked by the blocking lever.

In order to achieve an even more compact design with fewer parts, the pawl and release lever of the locking mechanism are in one embodiment rotatably mounted on a common axis.

Advantageously, the rotary latch is pretensioned by a spring in the direction of the opening position of the lock, in order to be able to initiate a moment in the pawl even without the presence of a door sealing pressure.

In one embodiment of the invention the release lever can move a blocking lever of the locking mechanism out of its blocking position. For this purpose, generally a relatively low force suffices. Where the pawl is subsequently moved out of its detent position by an opening moment initiated in the pawl by the rotary latch, the overall force required for opening the locking mechanism is advantageously very low.

One embodiment provides a spring for moving the blocking lever into its blocking position. The blocking lever can thus be simply and reliably moved into its blocking position by the spring. In one embodiment the blocking lever and pawl are designed in such a way that by moving the blocking lever in its blocking position the pawl is also moved into its detent position. The number of required parts is thus reduced further. At the same time both the weight and required space are also reduced.

In one embodiment, the release lever contains three lever arms. Using a first lever arm, a blocking lever is, in particular, moved out of its blocking position for unlocking the locking mechanism. A second lever arm of the release lever preferably releases the pawl in the described manner, i.e. the spring force able to move the pawl in the direction of the locking position is at least reduced during opening of the locking mechanism. Preferably, this second lever arm contains a tappet for moving the pawl out of its locked position, providing a compact and simply to produce design. The third lever arm is used for activating the release lever i.e. for instance with the aid of a rod arrangement or Bowden cable and preferably with the aid of a connected handle or an electric drive. If the handle is actuated or the electric drive is started, this also actuates the third lever arm and the release lever for unlocking the locking mechanism and said release lever is, in particular, pivoted around an axis. Advantageously, the invention also provides a stop for the second lever arm in order to minimize the required space and weight and prevent the release lever from being moved past a desired end position.

Preferably, the pawl contains two lever arms with one lever arm locking the rotary latch. A mechanism, such as a pretensioned spring acts on the other lever arm, in order to be able to move the pawl into its detent position with the aid of a mechanism, i.e. a pretensioned spring. This other lever arm of the pawl is optionally engaged by a tappet of the release lever to unlock the locking mechanism and is moved accordingly and is, in particular, pivoted around an axis. Advantageously also a stop is provided for this lever arm in order to prevent the pawl from being moved past its full detent position.

A blocking lever for blocking the pawl in its detent position includes preferably two lever arms. A first lever arm of the blocking lever can, in particular, block the pawl in its latched position and/or move the pawl into its latched position. In one embodiment in particular this first lever arm can also be advantageously engaged by the release lever and moved out of its blocking position by pivoting, in particular, around an axis. The second lever arm of the blocking lever can preferably be moved against a stop so that the blocking lever can be moved past a provided end position. The provision of a second lever arm also advantageously contributes to the centre of gravity of the blocking lever being moved in the direction of the axis around which the blocking lever can be pivoted. This movement of the centre of gravity facilitates pivoting of the blocking lever.

In one embodiment, the blocking lever can also function as the release lever in order to minimize the number of components. In one embodiment the release lever also functions as an intermediate closed position pawl that can lock the rotary latch in the intermediate closed position. The locking mechanism can then lock a door or flap. It is, however, not as yet locked as planned in the fully closed position. Starting from the intermediate locked position, the fully closed position is only reached if the rotary latch is pivoted further in the direction of the locked position.

A locking mechanism of the invention is in particular arranged on a metal lock plate or on a lock casing generally made of metal. Usually, such a lock also contains a lock housing, generally made of plastic and which can protect components of the lock against external influences. The arrangement can also contain a lock cover made, in particular, from plastic and/or, in particular, a plastic cover for a central locking also provided for protection. The lock can, for instance, be part of a door or flap of a building or of the door or a flap of a motor vehicle.

The invention also includes such a lock with a pawl for the fully closed position of the rotary latch (also referred to as "fully closed position pawl" and a pawl for the intermediate closed position of the rotary latch (also referred to as "intermediate closed position") and advantageously also a blocking lever for said fully closed position pawl. Such a lock is disclosed in publication DE 10 2008 061 524 A1. A lock of the invention can, however, in addition to the blocking lever, also include only one pawl for locking the rotary latch in an intermediate locked position and a fully closed position.

The rotary latch contains a fork-shaped inlet slot (infeed section), entered by a locking bolt of a door or flap when the vehicle door or flap is closed. The locking bolt then pivots the rotary latch from an opening position into a detent position. Once in the detent position, the locking bolt can no longer move out of the rotary latch. The pawl locks the rotary latch in the detent position so that it cannot be turned back into the open position.

A lock according to the invention contains components such as pawl, blocking lever or rotary latch that can and should be pivoted. Such arrangements regularly contain at least one pretensioned spring, in particular a leg spring, used for producing the desired pivoting movement of such a component as a result of the force of the spring. Such a pretensioned spring can, for instance, move a pawl into its detent position, a blocking lever into its blocking position or a rotary latch into its open position.

When in the detent position, the rotary latch can generally initiate an opening moment in the pawl. In particular, the rotary latch does not initiate a closing moment in the pawl and at least not when the locking mechanism is not deformed by excessive stresses. Generally, no excessive stresses exist when in the closed state of a door or a flap, no additional external forces (additional to an internal force, such as caused by a door sealing pressure) are initiated in the locking mechanism. Excessive stresses can, in particular, occur in the event of a crash where considerable forces are initiated in the locking bolt of the door or flap in the opening direction of the door or flap.

A predetermined bending point in the sense of the present invention can be confined to a small area or can extend over a longer area. The rotary latch can, however, also be designed in such a way that whilst deforming as a whole during excessive stressing, the overlap at least remains or increases.

DETAILED DESCRIPTION OF THE INVENTION

Figure 1:
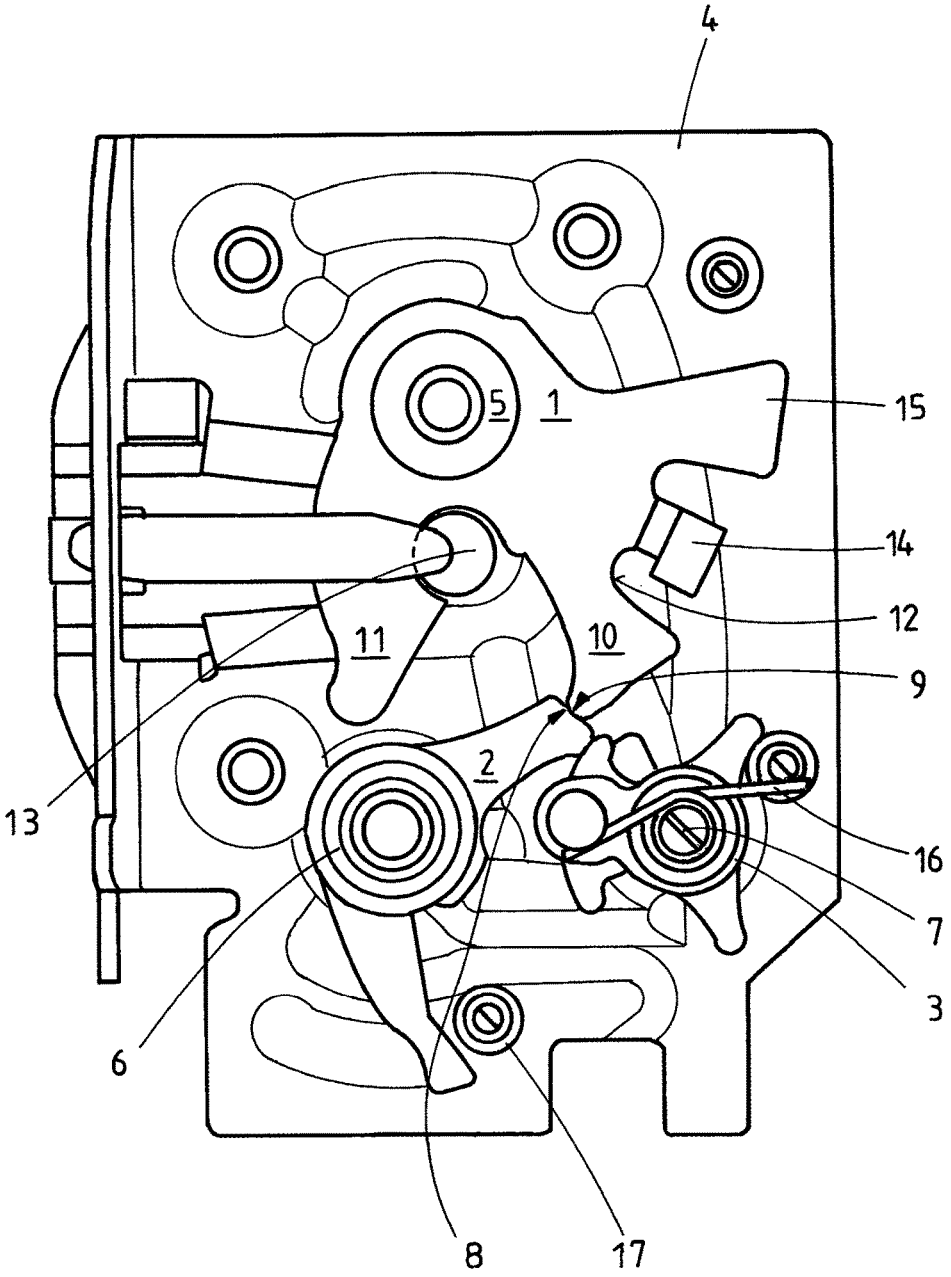
FIG. 1: a locking mechanism in its locked state

FIG. 1 shows a locking mechanism of a lock of a motor vehicle, comprising a rotary latch, a pawl 2 and a blocking lever 3 that are rotatably mounted on a lock case 4. The rotary latch 1 can be pivoted around its axis 5. The pawl 2 can be pivoted around its axis 6. The blocking lever 3 can be pivoted around its axis 7.

It must be noted that the invention is explained with reference to a lock consisting of several pawls, a so-called multiple pawl locking mechanism. The invention does, however, expressly not only relate to a multiple pawl locking mechanisms but is also applicable to all other locks with a locking mechanism.

Using its locking surface 8, the pawl 2 locks the rotary latch 1, resting with the locking surface 9 of its collecting arms 10 on the locking surface 8 of the pawl. In the example, an arrangement of the locking surface 8, 9 to each other has been chosen that ensures that the rotary latch 1 initiates an opening moment in the pawl 2. As a result of the opening moment, the pawl 2 can be pivoted out of its shown detent position and, in case of FIG. 1 by pivoting in clockwise direction around the axis 6 when the blocking lever 3 is moved out of its blocking position by actuation of an internal or external actuation means.

The overlap of the two locking surfaces 8 and 9 is such that the pawl 2 only has to be pivoted in clockwise direction by several degrees and, in particular, by less than 14.1° and preferably by less than 12.9° for the rotary latch to be pivoted in the open position, thus opening the locking mechanism. The bigger the overlap the more pawl 2 has to be pivoted in clockwise direction in order to open the locking mechanism.

The rotary latch 1 contains a collecting arm 10 and a load arm 11. The collecting arm 10 contains a predetermined bending point 12. The predetermined bending point can be provided in form of a preferably curved recess extending from one side or, as shown, from both sides of the collecting arm. When an excessive force as for instance in case of a crash is exerted on the locking bolt 13 held by the rotary latch 1 and the load arm 11 is thus pulled in the opening direction, the collecting arm 10 bends around the predetermined bending point 12 as a result of the predetermined bending point 12 and in relation to load arm 11 in counterclockwise direction. This deformation can be plastic and/or elastic. As a result, the contact point between the locking surface 9 and locking surface 8 is moved in such a way that the overlap of locking surfaces 8 and 9 is increased.

The rotary latch 1 contains an arm 14, extending into a plane located above the plane on which the bases of the rotary latch 1 and of the pawl 3 are located. Above pawl 2 a release lever—not shown—is provided on the axis 6 that also operates as an intermediate closed position pawl. In the intermediate closed position this arm 14 rests against the intermediate closed position pawl so that the locking mechanism can also be locked in an intermediate closed position. In this example of the embodiment the intermediate closed position arm 14 is a folded edge formed integrally with the rotary latch 1. It is, however, also possible to use an intermediate closed position arm 14 that is a separate bolt connected to the rotary latch 1. The rotary latch 1 can also contain an arm 15 that can, for instance, be moved against a stop in order to prevent excessive pivoting of the rotary latch.

The collecting arm 10 does not necessarily have to contain a tapered area, i.e. a recess 12 in order to be deformed in the desired manner. Alternatively also one or two recesses can be provided on one or both sides of the rotary latch 1. As a further alternative or, in addition, the rotary latch 1 can also have undergone heat treatment in order to form a predetermined bending point.

It may also suffice for the collecting arm 10 to have an adequately narrow width over its entire length in order to be bent over in this area in the described manner. Alternative or, in addition, the load arm 11 can contain a tapered area between the axis 5 and the shown position of the locking bolt 13 or can be narrow. In case of excessive stressing, the load arm 11 is, for instance, bent over in its tapered area, also resulting in a greater overlap of the two locking surfaces 8 and 9.

It is therefore particularly important that the rotary latch is designed in such a way that in case of excessive stressing by the locking bolt 13, the rotary latch is deformed in such a way that the overlap of locking surfaces 8 and 9 is at least not reduced. Preferably the overlap is even increased in case of excessive stressing.

FIG. 1 shows a pretensioned leg spring 16, able to move the blocking lever 3 in the direction of the blocking position. The blocking lever 3 must be pivoted in counterclockwise direction and against the force of this spring 16 around its axis 7, in order to open the locking mechanism. The blocking lever 3 and pawl 2 are designed in such a way that the blocking lever 3 can move the pawl 2 into its detent position. A stop 17 mounted on lock case 4 prevents the pawl 2 from being moved in counterclockwise direction past its detent position.

In a further advantageous embodiment, a recess 20 is additionally or exclusively provided that is arranged in the collecting arm 10 of the rotary latch 1 on the side facing the locking bolt 13. This produces a relatively long physically effective lever without having to increase the overall design accordingly and in comparison to the scenario in which a recess in form of an indentation is provided on the side facing away from the locking bolt. In case of excessive stressing of the lever, the overlap then increases significantly. An indentation exists where starting from the open position, the locking bolt has to be moved over a step-like section 19 of the contour of the collecting arm 10, in order to move into the closed position shown in FIG. 1.

Figure 2:
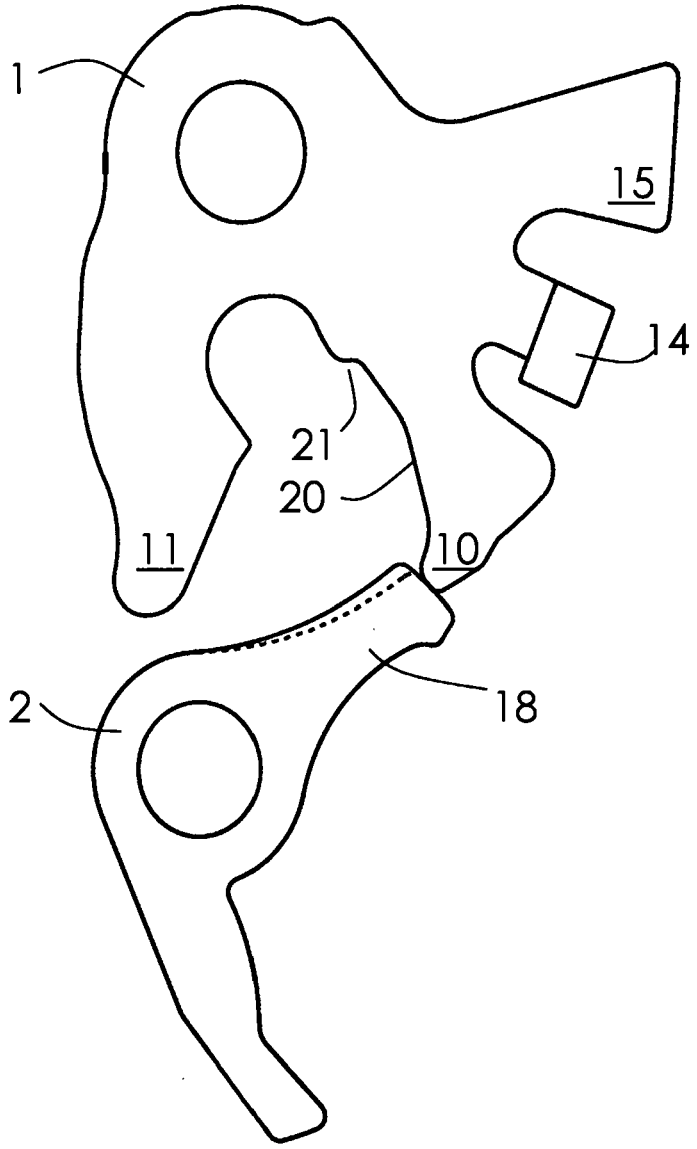
FIG. 2: a comparison of the width of a pawl arm of a usual locking mechanism with that of a locking mechanism of the invention

The dashed line in FIG. 2 indicates how a locking arm 1 of a pawl 2 can be designed in comparison to a usual width of a locking arm of a usual pawl. A pawl 2 of the invention does thus differ from a usual pawl by the lateral contour shown by the dashed line, resulting in a narrower locking arm. The narrower width of the locking arm 18 and the resulting locking surface 8 has the result that a smaller pivot movement of the pawl suffices for opening the locking mechanism.

Figure 3:
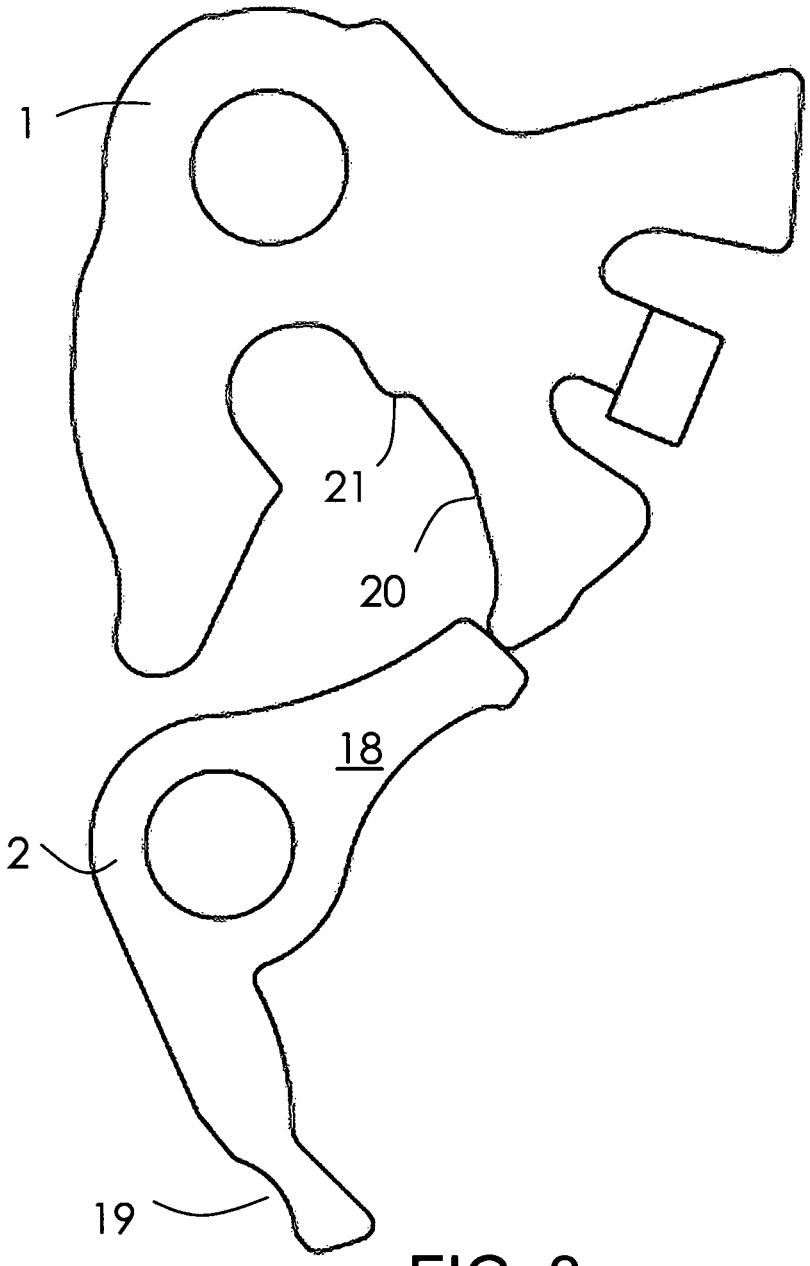
FIG. 3: other embodiments of the invention

FIG. 3 shows the existence of a bulge 19 on the other arm of the pawl 2, allowing for a reduction in weight and volume. This bulge 19 is positioned on the side facing away from the stop 17.

Particularly advantageous is an indentation 20, arranged in the load arm 10 of the rotary latch 1 on the side facing the locking bolt 13. This produces a relatively long physically effective lever without having to increase the overall design accordingly and in comparison to the scenario in which a recess in form of an indentation is provided on the side facing away from the locking bolt 13. In case of excessive stressing of the lever, the overlap then increases significantly. An indentation exists where starting from the open position, the locking bolt 13 has to be moved over a step-like section 21 of the contour of the collecting arm 10, in order to move into the closed position shown in FIG. 1.

Figure 4:
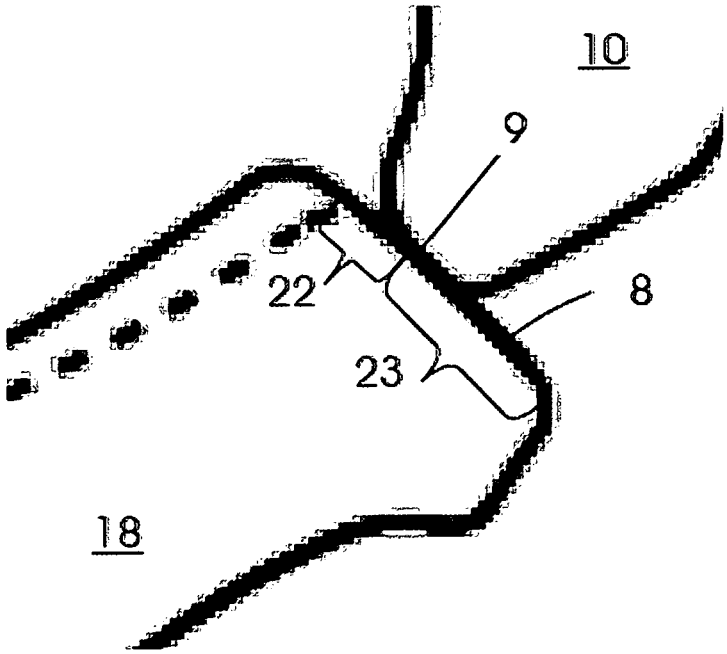
FIG. 4: an enlarged view of the embodiment of FIG. 2

FIG. 4 shows an enlarged excerpt of the locking arm 18 of the pawl 2 and the collecting arm 10 of the rotary latch 1 in which the course of the deviation—shown by a dashed line—of the particularly preferred inventive embodiment is shown in comparison to the usual course. The support point of the collecting arm 10 of the rotary latch on the locking surface 8 of the pawl 2, is arranged in such a way when the locking mechanism is in its locked position, that the distance 22 to the one end of the locking surface 8, shown on the left is smaller than the distance 23 to the other opposite end of the locking surface. As shown, in particular, in FIG. 1, the end shown on the left is the end past which the collecting arm 10 of the rotary latch 1 has to be moved, in order to unlock the locking mechanism. The length of the distance 22 is approx. 30% of the total of the two sections or of distances 22 and 23 and thus approx. 30% of the width of the locking surface 8.

LIST OF REFERENCE NUMBERS

1: Rotary latch
2: Pawl
3: Blocking lever
4: Lock case
5: Pawl axis
6: Common axis of pawl and release lever
7: Blocking lever axis
8: Locking surface of pawl
9: Locking surface of rotary latch
10: Collecting arm
11: Load arm
12: Predetermined bending point
13: Locking bolt
14: Arm for locking in intermediate closed position
15: Arm
16: Leg spring
17: Stop for blocking lever
18: Locking arm of pawl
19: Indentation
20: Indentation
21: Step-like contour
22: First section of locking surface of pawl
23: Second section of locking surface of pawl

The invention claimed is:

1. A lock for a door or flap comprising a locking mechanism having a locked state and an unlocked state, the locking mechanism comprising:

a rotary latch having a first locking surface; and a pawl having a second locking surface that is engageable with the first locking surface for locking the rotary latch, wherein engagement of the second locking surface of the pawl with the first locking surface of the rotary latch creates an overlapping surface area between the pawl and rotary latch, the second locking surface extending between a first end and a second end distally opposite the first end, the rotary latch being pivotable past the first end of the second locking surface for moving the locking mechanism from the locked state to the unlocked state, wherein when the locking mechanism is in the locked state, the rotary latch is deformable by excessive stressing and the overlapping surface area between the pawl and the rotary latch is increasable by way of deformation of the rotary latch to maintain the engagement between the pawl and the rotary latch, and wherein the rotary latch has a support point located at a central location along the first locking surface, wherein a length between the support point and the first end of the second locking surface is less than a length between the first end and the second end of the second locking surface when the second locking surface is engaged with the first locking surface, wherein pivoting of the pawl by 16.1° or less allows the rotary latch to be pivoted to move the locking mechanism from the locked state to the unlocked state.

2. The lock according to claim 1, wherein the rotary latch includes a collecting arm and the support point is located on the collecting arm with the first end of the second locking surface being the end past which the collecting arm of the rotary latch has to be moved when the rotary latch is pivoted to move the locking mechanism from the locked state to the unlocked state.

3. The lock according to claim 2, wherein the rotary latch contains a predetermined bending point, causing the distance between the support point of the collecting arm and a load arm of the rotary latch to increase when exposed to excessive stressing whilst the locking mechanism is in its locked state thereby deforming the rotary latch to increase the overlapping surface area.

4. The lock according to claim 3, wherein the predetermined bending point is arranged on the collecting arm and contains a recess arranged on a side of the collecting arm of the rotary latch which in the locked state of the locking mechanism is positioned on a side facing away from a locking bolt of a door or of a flap.

5. The lock according to claim 1, wherein the length between the support point and the first end of the second locking surface is up to 40% of the length between the first end and the second end of the second locking surface.

6. The lock according to claim 1, wherein the locking mechanism cannot be opened by forces between 10 kN and 30 kN.

7. The lock according to claim 1, wherein the rotary latch comprises an arm by which the rotary latch can be locked in an intermediate closed position and with the arm ending outside of a main plane of the rotary latch.

* * * * *